United States Patent [19]

Kessler

[11] Patent Number: 4,999,957

[45] Date of Patent: Mar. 19, 1991

[54] LOCK-FLANGED HINGED NAILING FIN FOR WINDOWS

[76] Inventor: Gerald Kessler, 302 McClurg Rd., Youngstown, Ohio 44501

[21] Appl. No.: 450,186

[22] Filed: Dec. 13, 1989

[51] Int. Cl.[5] ..... E06B 1/04

[52] U.S. Cl. ..... 52/213; 49/504

[58] Field of Search ..... 52/204, 208, 202, 203, 52/213, 403; 49/504

[56] References Cited

U.S. PATENT DOCUMENTS 4,184,297 1/1980 Casamayor ..... 52/403

4,821,472 4/1989 Tix ..... 52/213

*Primary Examiner*—James L. Ridgill, Jr.

*Attorney, Agent, or Firm*—Browdy and Neimark

[57] ABSTRACT

A foldable nailing fin for a window assembly having hingedly attaching strips along adjoining edges for releasably folding two elongated strips, wherein the strips and means hingedly attaching the strips are made of polypropylene, and a flange member extending from a first strip over the hingedly attaching means toward a second strip has a tongue section on a distal end which forms a latch hook with a hook section on a second elongated strip.

11 Claims, 2 Drawing Sheets

FIG. 3
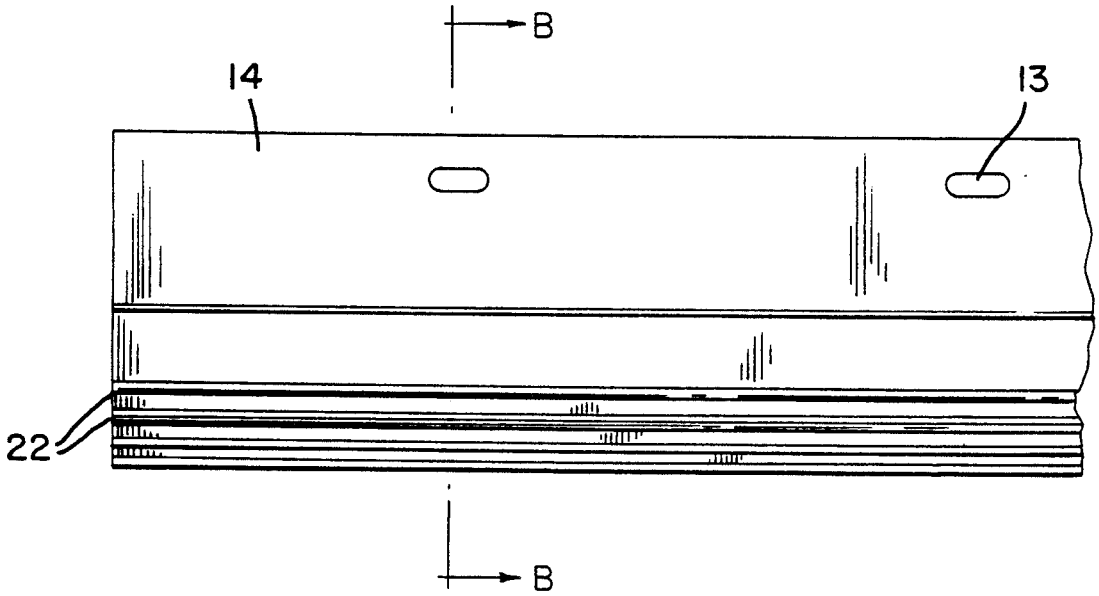
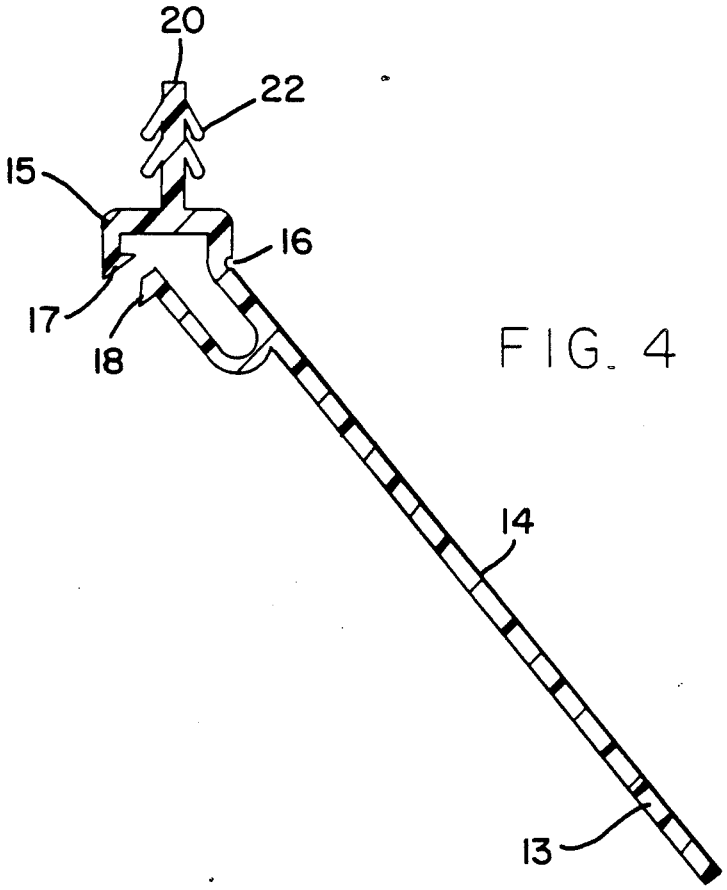
FIG. 4

LOCK-FLANGED HINGED NAILING FIN FOR WINDOWS

FIELD OF THE INVENTION

The invention relates to a lock-flanged hinged nailing fin made entirely of polypropylene for mounting window installations or assemblies to a surrounding supporting structure, such as the wall of a house.

DESCRIPTION OF THE PRIOR ART

Nailing fins for attaching window assemblies to wall structures of a house or building being constructed are known and have been utilized for some time in the home building industry. Generally speaking, the fins or bands or strips of stiff material such as metal or plastic are attached along one elongated edge to the periphery of the frame of the window assembly and have holes through which nails are placed to attach the fin to the surrounding supporting structure in order to hold the window assembly in place.

In the case where a wing or flange is formed integrally with the nailing section of the nailing fin to extend out over a hinge section thereof, the hinged section is made of different material than the nail fin itself and this necessitates the use of dual extruders and give rise to dual durometer materials being formed during the extrusion process of making the hinged nailing fin. U.S. Pat. No. 4,821,472 typifies the hinged nailing fin prepared using two separate extruders wherein the hinged nailing fin is made of two different plastics and therefore is subject to higher cost in its manufacture.

While such a hinged construction provides numerous advantages, the hinged nailing fin of the prior art having a wing or flange formed integral with the nailing section has the disadvantage of affording no protection against the window being blown out during a period of high winds or forced out as a result of, for example, a person washing the window from the inside and leaning on the frame.

Therefore, a first need exists in this art to reduce costs by eliminating the dual durometer materials occasioned by the use of two separate extruders to make the hinged nailing fin in which the elongated strip section is made of one plastic material and the flexible hinge section is made of a different plastic material. A second need exists to provide some assurances against having a window blow out or forced out once the hinged nailing fin having the wing or flange formed integral therewith has been used to install the window frame into an opening in the wall of a building being constructed.

SUMMARY OF THE INVENTION

It is therefore an object of the invention to overcome deficiencies in the prior art, such as indicated above. It is another object of the invention to provide improvements in window frames having nailing fins.

The wing or flange nailing fin of the instant invention is an integrally formed polypropylene strip having a relatively wide and thin elongated polypropylene member containing nail holes for attaching the strip to a support structure, the narrow thin elongated polypropylene member having an elongated edge parallel and closely adjacent to the elongated edge of the first member, and a narrower thin flexible polypropylene member hingedly connecting the first and second members along their parallel adjacent edges in order to releaseably fold together the first and second members and means for attaching the second member to a side of a window assembly.

The wing or flange member formed integrally with the nailing section of the nailing fin and which extends out over the hinge section is provided with a tongue section which snap fits into a hook or groove section of the second elongated narrower thin band or strip of polypropylene material, in order to form a lock which prevents the window from being blown out or forced out. The nailing fin may be attached to the window assembly in any suitable way, such as by resting or placing one edge in an elongated kerf or in an elongated T-shaped groove in the frame of the window assembly with integrally formed flexible plastic barbs holding it securely to the window assembly, and this avoids the use of stapling, nailing or using an adhesive to attach the nailing fin to the window frame.

BRIEF DESCRIPTION OF THE DRAWING

FIG. 3 is a perspective view of a preferred embodiment of the invention; and FIG. 4 is a sectional view taken along the line B—B of FIG. 3.

DETAILED DESCRIPTION OF THE INVENTION

Figure 1:
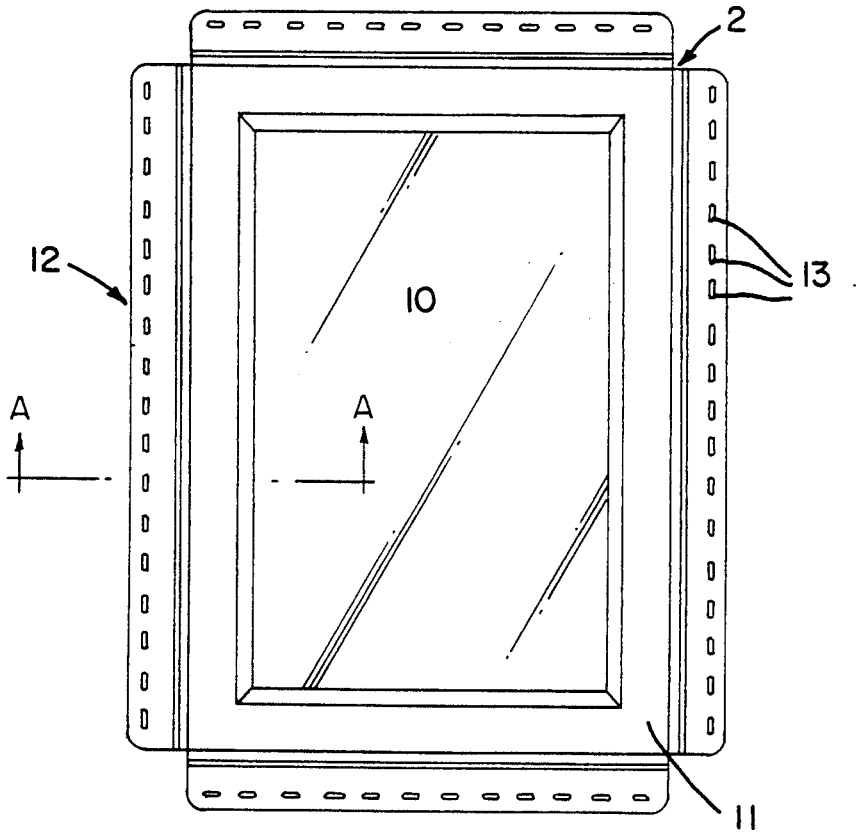
FIG. 1 is a perspective view of a window assembly with the attached nailing fin of the invention.

FIG. 1 depicts a window assembly, designated by numeral 2, and made up of a pane of glass 10 within a vinyl plastic, aluminum, or wood frame 11 which may be clad in a plastic or metal outer protective layer. Nailing fins 12 are attached to the outer edge of the window frame 11. Installation is effected by inserting the window assembly into an opening in the wall of a house or building, so that nailing fins 12 are rested against the surrounding supporting structure. At this point, nails (not shown) are driven through the nail holes 13 into the structure in order to firmly hold the window assembly in place.

The depiction in FIG. 1 illustrates the amount of space needed if the window assembly is shipped with the nailing fins attached thereto. It is clear from this figure that a shipping container must be sufficiently large to accommodate the additional space needed for the nailing fins and also provide more protection against damage to the nailing fins.

Figure 2:
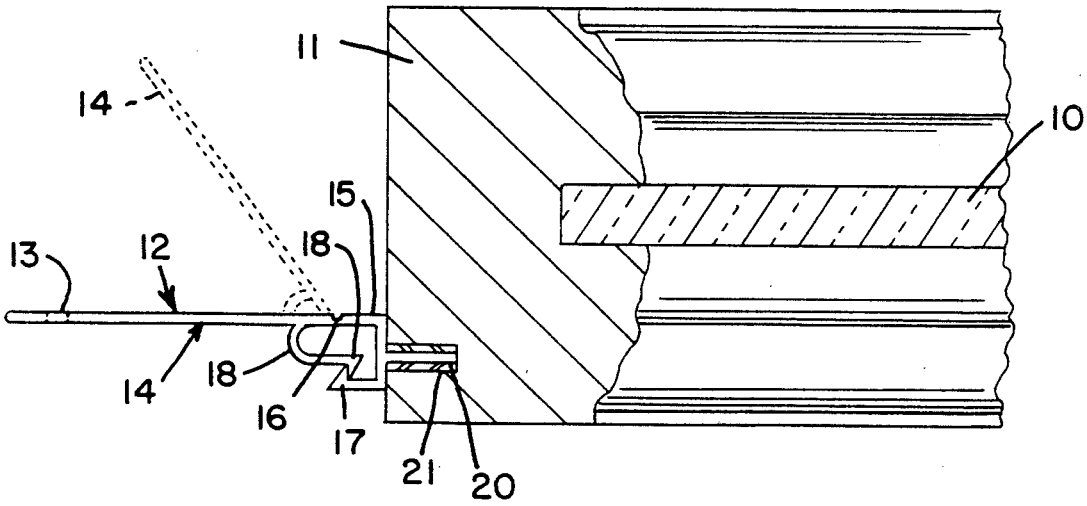
FIG. 2 is a sectional view taken along line A—A of FIG. 1 illustrating the preferred embodiment of the invention.

In the preferred embodiment of the invention as seen in FIG. 2, the nailing fins 12 stand outwardly or laterally from the frame 11 and secure nails (not shown) inserted through the nail holes 13 into the supporting frame structure (not shown).

As can be seen from FIGS. 2, 3 and 4, the nailing fin of the invention has an elongated thin wide section 14 made of polypropylene, with nailing holes 13 therein. The second narrower section 15 of polypropylene material extends in parallel relationship to member 14 along one edge and members 14 and 15 are adjoined together along their adjacent edges by an extremely narrow strip or hinge-band 16 of flexible polypropylene material.

In the preferred embodiment, section 15 is of a L-shaped configuration and has a groove or hook 17 on a short extension thereof which is in parallel relationship with elongated wide section 14. Groove or hook portion 17 permits a tongue portion 18 on the distal end of the wing or flange 19 to be snapped in place. Section 15 has a leg 20 which is inserted in a kerf 21 in the outer frame 11 of the window assembly. Resilient polypropylene barb-shaped lengths or projections 22 extend out along each side of leg 20 and serve to grip the inner walls of the kerf 21 to firmly hold leg 20 in the nailing fin attached to the window assembly.

While this is one method of attaching the nailing fin, it is to be understood that the nailing fin may be attached with a suitable adhesive or stapled or nailed to the outside edge or periphery of the window frame.

It is clear that the nailing fin 12 is integrally formed in one piece, extruded from a single die, and all of the sections and parts, i.e. the nailing section 14, second narrower section 15, hinged or extremely narrow strip or hinge-band 16, and the barbs 22, are extruded in a single extrusion process, and the entire nailing fin including the hinged section 16 and the groove and tongue section which form the latch hook are all made of polypropylene. While the invention is described in conjunction with the nailing fin 12 being formed of polypropylene because polypropylene has unique or almost unique characteristics which provide both sufficient rigidity and good hinge properties, it will be understood that other specially engineered materials having the same properties could be used in place of polypropylene.

It is clear from the dashed line in FIG. 2 that nailing section 14 of the nailing fin may be folded up along the hinge line which defines the narrow strip or band 16 in order to enable it to rest along the side of frame 11 of the window assembly and thereby occupy little additional space when the window assembly is attached to the nailing fin and placed in a carton or container for shipping.

Wing or flange 19 is formed integrally with the nailing section 14 of the nailing fin and extends out over the hinge section or extremely narrow strip 16. In this arrangement, protection is provided for the hinge section when the nailing fin is in place and this also serves to ensure that the nailing section is kept lateral with the window assembly. The latch hook section formed by groove or hook 17 and tongue 18 formed respectively integrally with the second narrower section 15 and the wing or flanged section 19, allow the latch hook to snap in place to thereby provide assurances against pushing out the window assembly from the inside of the house or building if a party is leaning against it. This novel arrangement also prevents the window from being blown out in a inclement weather environment in which high winds prevail.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. As a foldable nailing fin for a window assembly having a window glass enclosed by a surrounding frame, an elongated integrally extruded unitary strip of polypropylene or the like comprising:

(a) a wide thin elongated section containing nail holes for attaching the strip to a support structure;

(b) a narrow thin elongated section having a generally U-shaped cross-section with two legs, one side leg terminating in an elongated edge parallel and closely adjacent to an elongated edge of said first-mentioned member, and said other leg having a hook portion projecting therefrom;

(c) a still narrower thin flexible section hingedly connecting together said first and second sections along their parallel adjacent edges for releasably folding together said first and second mentioned sections;

(d) means for attaching said second section to a side of a window assembly; and (e) a flange member extending from said wide section over said connecting member toward said narrow thin elongated section, said flange member having a tongue portion on a distal edge thereof, said tongue portion forming a latch hook for cooperation with said hook portion on said narrow thin elongated section.

2. The foldable nailing fin of claim 1, wherein said means for attaching said second member to a side of a framed window assembly comprises:

an elongated opening in a side of the window frame; and barb-like flexible plastic strips integrally formed with said second-mentioned section for holding the sidewall of said elongated opening.

3. The foldable nailing fin of claim 1, wherein said thin elongated sections are of equal thickness.

4. In a foldable nailing fin for a window assembly comprising:

a first elongated strip of material containing nail holes for attaching said first elongated strip to a support structure;

a second elongated strip of material with an elongated edge parallel to and adjoining an elongated edge of said first elongated strip;

means for attaching said second elongated strip lengthwise to a side of the frame of a window assembly; and flexible hinge means hingedly attaching said first and second strips along said adjoining edges for relative rotation and folding of said strips;

the improvement further comprising locking means for locking said first elongated strip relative to said second elongated strip so that said first and second strips are in the same plane and to prevent relative rotation between said first elongated strip and said second elongated strip about said flexible hinge means.

5. The foldable nailing fin of claim 4, wherein said locking means comprises a flange member extending from said first strip over said hingedly attaching means toward said second strip, said flange member having a tongue section on a distal end which forms a latch hook with a hook section on said second elongated strip.

6. The nailing fin of claim 4, wherein said means for attaching the second elongated strip to the window frame comprises:

retention means adjacent a distal elongated edge of said second strip for retention within a kerf or groove of a window frame.

7. The foldable nailing fin of claim 6, wherein said retention means comprises hooklike resilient projections integrally formed with said second strip adjacent its distal elongated edge when the distal elongated edge of said second strip is inserted in the kerf or groove.

8. In combination:

a window assembly comprising a window glass enclosed around its edges by a surrounding window frame;

a foldable nailing fin comprising a first elongated strip of material containing nail holes for attaching said first strip to a support structure, a second elongated strip of material with an elongated edge parallel to and adjoining an elongated edge of said first strip, and a third resilient strip hingedly attaching together said first and second elongated strips along their adjoining edges; and means for attaching said second strip lengthwise to a side of the frame of said window assembly, the improvement comprising:

locking means for locking said third resilient strip to prevent rotation of said first strip relative to said second strip about said third strip.

9. The combination of claim 8, wherein said first and second strips and said third resilient strip are polypropylene.

10. The combination of claim 8, wherein said means for attaching said second strip to said window assembly, comprises:

an elongated opening in a side of the window frame assembly; and means adjacent the distal elongated edge of said second strip for holding said opening.

11. The combination of claim 10, wherein said locking means comprises a flange member extending from said first strip over said hingedly attaching strip toward said second strip;

said flange member having a tongue section on a distal end which forms a latch hook with a hook section on said elongated strip.

* * * * *